United States Patent [19]

Heidt

[11] 3,990,374

[45] Nov. 9, 1976

[54] CONTACTLESS SYNCHRONIZER FOR SEWING MACHINES

[75] Inventor: Alfred Heidt, Schwetzingen, Germany

[73] Assignees: Frankl & Kirchner; Fabrik fur Elektromotoren u. elektrische Apparate, both of Schwetzingen, Germany

[22] Filed: Mar. 28, 1975

[21] Appl. No.: 562,921

[52] U.S. Cl. ..... 112/219 A

[51] Int. Cl.[2] ..... D05B 69/22

[58] Field of Search ..... 112/219 A, 219 B, 220, 112/221, 67, 87

[56] References Cited

UNITED STATES PATENTS

| | | | |
|---|---|---|---|
| 3,659,538 | 5/1972 | Bosken et al. | 112/219 A |
| 3,757,232 | 9/1973 | Matsuda | 112/219 A X |
| 3,851,237 | 11/1974 | Yokoyama et al. | 112/219 A X |
| 3,881,435 | 5/1975 | Makabe | 112/219 A |

FOREIGN PATENTS OR APPLICATIONS

| | | | |
|---|---|---|---|
| 330,221 | 4/1972 | U.S.S.R. | 112/219 A |

*Primary Examiner*—H. Hampton Hunter

*Attorney, Agent, or Firm*—Browdy and Neimark

[57] ABSTRACT

A contactless synchronizer for sewing machines has been developed. This synchronizer contains at least two transmitting elements which rotate with the sewing machine shaft and indicate the angular position of the machine with respect to stationary sensing elements. These sensing elements form a part of the entire circuit of the machine and produce control pulses as each transmitting element passes a sensing element.

10 Claims, 3 Drawing Figures

CONTACTLESS SYNCHRONIZER FOR SEWING MACHINES

BACKGROUND OF THE INVENTION

1. Field of the Invention

The present invention relates to a contactless synchronizer for sewing machines. The synchronizer according to the invention comprises at least two transmitting elements which are angularly displaced with respect to each other, which rotate with the sewing machine shaft and which indicate its angular position in cooperation with stationary sensing elements. The afore-mentioned sensing elements form parts of a circuit for producing control pulses as each transmitting element passes the respective sensing element.

2. Description of the Prior Art

A synchronizer of this type is disclosed in German OS 1 907 975 wherein two shutter disks with slots are mounted on the rotating shaft. In a position which is spaced apart from the sewing machine shaft there is disposed between the two disks a magnetic coil which serves as a transmitter and axially parallel with the magnetic coil serving as a transmitter there is disposed on the other side of each shutter disk a magnetic coil which serves as a receiver. The shutter disks are made of a material which screens the magnetic field between the transmitter and the receiver and thus a signal is only emitted in the receiver if there is a slot between the transmitter and the receiver.

This known synchronizer has proved extremely successful in use.

SUMMARY OF THE INVENTION

The object of the present invention is to simplify a synchronizer of the type described above.

This problem is solved according to the invention in that the sensing elements are in the form of field plates which are attached to a magnet and connected in series in an adapted Wheatstone bridge connection and in that the transmitting elements are in the form of ferromagnetic elements which are mounted on the rotary shaft but spaced apart therefrom and which pass close by their associated field plate in the course of rotation. The configuration according to the invention is extremely simple and thus very economical. If the magnet consists of a permanent magnet it is only necessary to provide this simple permanent magnet, two relatively small field plates and the transmitting element which rotates with the shaft and which consists, as a rule, of two small iron components. If, during rotation of the shaft, a transmitting element is displaced past the respective field plate, the ohmic resistance thereof is altered by virtue of the constriction of the current threads caused by the variation in the magnetic field produced by the so-called Hall effect and, as a result, the previously adjusted bridge connection is detuned. The bridge connection thus emits a signal.

If the other transmitting element is displaced past the other field plate the bridge is again detuned with the difference that a signal having a different potential is emitted. These signals can then be used to control a brake for accurately arresting the sewing machine in a specific needle position, for actuating a thread cutter, etc., as is disclosed, for example in German patent 1 291 014 or German OS 1 925 301.

Essentially it is also possible for the transmitting elements to consist of magnets which rotate with the shaft instead of stationary magnets. These rotating magnets would produce the same effect during displacement past the respective field plate. However, this version has the constructional disadvantage that the size of the rotating bodies would be increased which is not desirable in view of the high speeds of modern sewing machines. On the other hand, when the magnets are stationary, the transmitting elements need only consist of small flat iron pieces.

The transmitting elements are advantageously attached to control arms mounted on the rotary shaft. An optimum result is achieved if the field axis of the magnet is disposed approximately radially with respect to the rotating shaft and if the field plates are disposed generally perpendicular to the field axis, as, under these circumstances, the resistance variation during the displacement of the transmitting elements past the field plates is greatest.

This effect is further improved if the extension of the field plates is greater in the direction of rotation of the transmitting elements than radially with respect to the rotating shaft.

Other objects, features and advantages of the present invention will be made apparent in the course of the following detailed description of a preferred embodiment thereof provided with reference to the accompanying drawings.

DESCRIPTION OF THE PREFERRED EMBODIMENT

Figure 1:
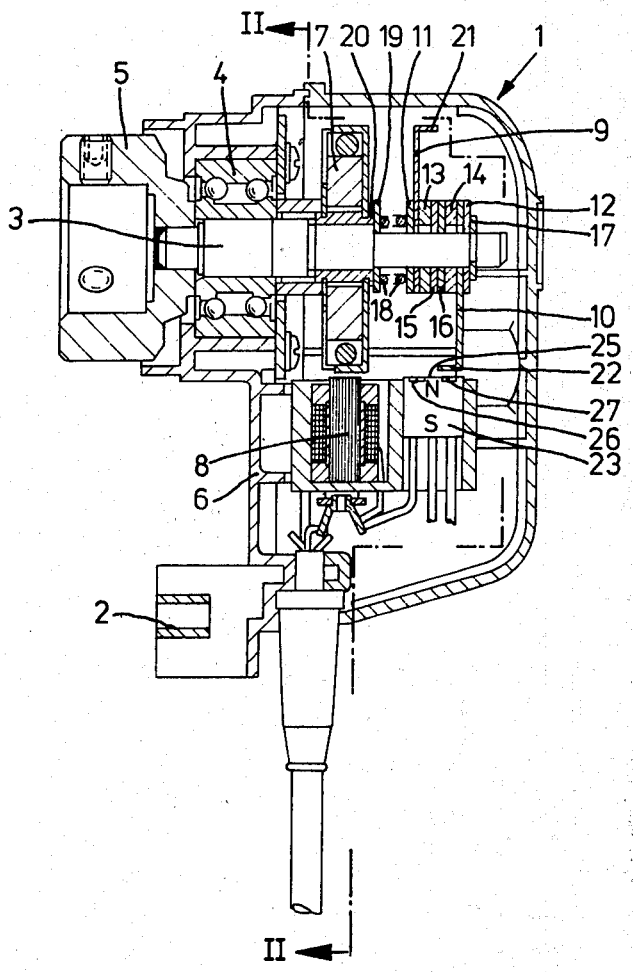
FIG. 1 is a longitudinal sectional view of a control head containing the synchronizer. The control head comprises two rotating control arms with transmitting elements attached thereto.
Figure 2:
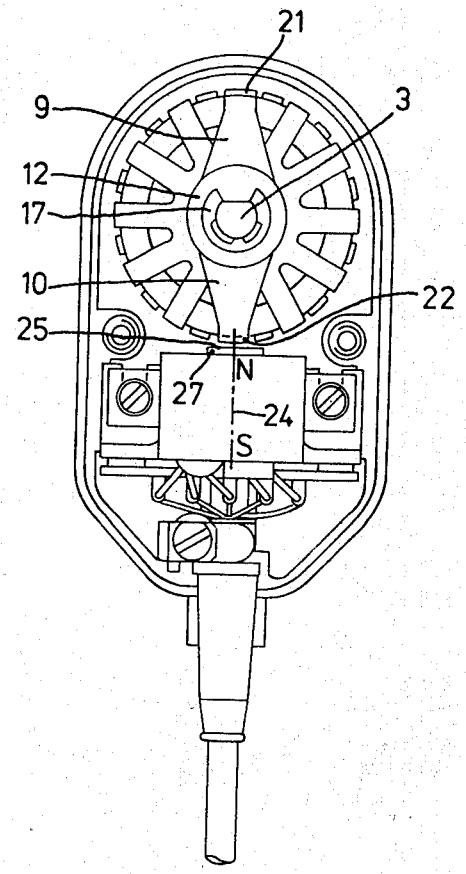
FIG. 2 is a view of the control head along a line II—II according to FIG. 1 and, FIG. 3 shows a bridge connection of the sensing element of the synchronizer.

A control head of a synchronizer comprises a housing 1 on which is mounted a socket 2 into which is inserted a pin attached to the upper part of the sewing machine to prevent the housing 1 from being rotated with respect to the upper part of the sewing machine. In the housing 1 an inner shaft 3 is rotatably mounted in a double-row ball bearing 4 and is axially and radially free from play. On the end of the inner shaft 3 projecting from the housing 1 there is mounted a connection socket 5 which does not rotate with respect to the inner shaft 3. By means of the socket 5 the inner shaft can be coupled to the corresponding coupling piece of the upper shaft of a sewing machine for synchronous rotation therewith. The ball bearing is disposed in a base plate 6 on the side of the housing 1 facing towards the sewing machine. The socket is also attached to the base plate 6. On the free collar part of the inner shaft 3 there is firstly disposed in a non-rotatable manner the pole wheel 7 of a revolution generator, the stator 8 of which is non-rotatably disposed in the housing below the pole wheel 7. Following thereupon, two control arms 9,10 are attached to the inner shaft. These rest directly against a supporting disk 11 or 12 disposed on the outer side of the two supporting arms 9 or 10 and against a friction ring disk 13 or 14 consisting of frictional material disposed between the two control arms. Two supporting disks 15, resp., 16 are disposed between the two friction ring disks. The four supporting disks 11,12,15,16 are non-rotatably secured to a flattened portion of the respective part of the inner shaft 3. The supporting disk 16 which faces towards the free end of the inner shaft 3 is secured against axial displacement by a Seeger ring 17. The opposite supporting disk 11 is biased by a prestressed compression spring 18 which rests with its other end against a corresponding stop collar 20 on the inner shaft 3 with interpositioning of an annular disk 19. By virtue of this configuration the control arms 9, resp., 10, will remain non-rotatably fixed in their initially adjusted position relative to the inner shaft 3 as long as no forces are produced in addition to the forces of inertia produced during acceleration or deceleration of the inner shaft. However, upon the exertion of sufficiently powerful tangentially directed restoring forces the friction, particularly the friction between the control arms 9 resp., 10 is overcome and the position of the control arms with respect to the inner shaft can be accurately adjusted.

At their free end, axially parallel to the inner shaft 3, the control arms 9,10 bear small plates 21 or 22 made of ferromagnetic material, generally iron.

A permanent magnet 23 is mounted in a stationary manner in the housing 1 and is radially disposed with respect to the control arms 9,10. The field axis 24 of the permanent magnet 23 is also radially disposed with respect to the inner shaft 3, that is, the north pole N and the south pole S of this permanent magnet 23 are radially disposed with respect to the inner shaft 3. The surface 25 of the permanent magnet 23 which faces towards the control arms 9,10 is disposed generally parallel to a tangential plane on the cylinder which is clamped by the plates 21,22 during rotation of the inner shaft. Two field plates 26,27 which advantageously consist of a semi-conductor material such as indium arsenite or indium antimonide are mounted on the surface 25. They are electrically insulated, for example, by means of a plastic adhesive. The field plates 26,27 are penetrated perpendicularly by the field axis 24 of the permanent magnet 23. Their thickness, that is, their extension is much smaller in the radial direction with respect to the inner shaft 3 than their breadth in the direction of rotation of the control arms 9,10.

Figure 3:
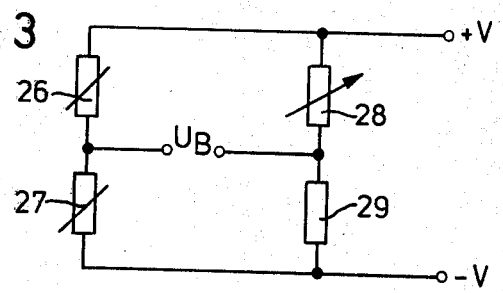

As shown in FIG. 3, these two field plates 26,27 are connected in series and connected to two resistances 28,29, which are also disposed in series, to form a bridge connection. For the purpose of tuning the bridge connection, a resistance 28 may be in the form of a variable resistance, for example, a potentiometer. There is a voltage at the bridge of, for example, a plus against a minus. In the adjusted state of the bridge, that is, when the plates 21 or 22 of a control arm 9,10 are not disposed in front of the field plates 26 or 27, the bridge voltage is $U_B = 0$. A current of 4–6 mA flows through the field plates. If a plate 21 of a control arm 9 is now brought closer to the one field plate 26 as a result of the rotation of the inner shaft 3, the ohmic resistance of this field plate 26 is increased, thereby causing detuning of the bridge connection. A bridge voltage $U_B \neq 0$ is thus produced. The air gap between the field plate and the transmitting element should not exceed 0.2–0.3 mm when the transmitting element passes in front of the respective field plate.

If the other plate 22 mounted on control arm 10 is displaced past the other field plate 27, the ohmic resistance of the latter is increased and, as a result, the bridge connection is again detuned. However, in this case, a bridge voltage of $U_B \neq 0$ having an opposite direction to the first described case, is produced.

By virtue of the above-described configuration it is thus possible, during rotation of the inner shaft 3 and thus of the upper shaft of the sewing machine, for differing signals to be produced which chronologically correspond to specific angular positions of the sewing machine shaft, thereby indicating these positions and simultaneously indicating specific needle positions of the sewing machine. These signals can then be used, for example, in the manner described in German patent 1 291 014 to brake the sewing machine with the needle in a specific position. It is obviously possible for an additional plate to be associated with the one field plate, either on the same control arm or on another control arm. This additional plate would, for example, be advanced by a fixed or adjustable angle with respect to the other associated plate such that the arresting of the sewing machine in an upper needle position is released by the first signal. An application of this type is described in detail in German OS 1 925 301.

The change in the resistances of the field plates 26 or 27 during the passage of the plates 21,22 disposed on the control arms 9,10, is produced in the following manner: when a plate 21 or 22 passes in front of a field plate 26,27, the magnetic field passing vertically through the field plates is altered considerably which causes a constriction of the current lines in the field plate according to the so-called Hall effect, thereby increasing its ohmic resistance as, at the time of the change in the magnetic field, only a portion of the cross-section of the particular field plate has current flowing through it.

What is claimed is:

1. A contactless synchronizer for sewing machines having a rotary shaft, the synchronizer comprising at least two transmitting elements of ferromagnetic material fixedly coupled to said rotary shaft and rotatable therewith along a path, said transmitting elements being angularly displaced from each other and radially displaced from said rotary shaft; a bridge circuit including a pair of magnetic-field responsive impedances series connected in two arms of said bridge circuit; a stationary magnet, each of said impedances being fixed to said magnet, and being positioned near said path whereby the bridge circuit produces pulse signals indicative of angular position of the shaft upon passing of the transmitting elements along the path past the impedances.

2. A synchronyzer as claimed in claim 1, wherein said magnet is a permanent magnet.

3. A synchronizer as claimed in claim 1, including control arms, said control arms being mounted on said rotary shaft; and wherein said transmitting elements are secured to said control arms.

4. A sunchronyzer according to claim 1 wherein said magnet has a given field axis, said field axis being disposed substantially radially with respect to said rotary shaft.

5. A synchronizer according to claim 4, wherein said impedances are field plates disposed substantially perpendicular to said field axis.

6. A synchronizer according to claim 5, wherein the extent of said field plates is greater in the direction of rotation of said transmitting elements than radially with respect to said rotary shaft.

7. A synchronizer according to claim 1, wherein said impedances are electrically insulated from said magnet.

8. A synchronizer according to claim 1, wherein said impedances are of semiconductive material.

9. A synchronizer according to claim 1, wherein said impedances are of indium arsenite.

10. A synchronizer according to claim 1, wherein said impedances are of indium antimonide.

* * * * *